US005654040A

United States Patent [19]

Matsunaga

[11] Patent Number: 5,654,040

[45] Date of Patent: Aug. 5, 1997

[54] METHODS AND APPARATUS USING MOVABLE MEMBER FOR SPRAYING A LIQUID OR HOT MELT MATERIAL

[75] Inventor: Masafumi Matsunaga, Yokohama, Japan

[73] Assignee: Nordson Corporation, Westlake, Ohio

[21] Appl. No.: 648,690

[22] Filed: May 16, 1996

[30] Foreign Application Priority Data

May 18, 1995 [JP] Japan ..... 7-143863

[51] Int. Cl.[6] ..... B05D 1/30; B05C 5/00

[52] U.S. Cl. ..... 427/420; 427/422; 427/424; 427/426; 118/302; 118/324; 118/DIG. 4; 239/431; 239/424; 239/426; 239/433; 239/568

[58] Field of Search ..... 427/420, 422, 427/424, 426; 118/302, 304, 324, DIG. 4; 239/431, 424, 426, 433, 568

[56] References Cited

U.S. PATENT DOCUMENTS

| | | | |
|---|---|---|---|
| 4,128,667 | 12/1978 | Timson | 427/420 |
| 4,346,849 | 8/1982 | Rood | 239/597 |
| 4,767,057 | 8/1988 | Degli et al. | 239/296 |
| 5,409,733 | 4/1995 | Boger et al. | 427/420 |
| 5,418,009 | 5/1995 | Raterman et al. | 427/420 |
| 5,423,935 | 6/1995 | Benecke et al. | 156/291 |
| 5,427,317 | 6/1995 | Huttlin | 239/424 |

FOREIGN PATENT DOCUMENTS

| | | | |
|---|---|---|---|
| 6150655 | 11/1986 | Japan . | |
| 62204873 | 9/1987 | Japan . | |
| 3-242259 | 10/1991 | Japan | 118/DIG. 4 |
| 6170308 | 6/1994 | Japan . | |
| 6-226195 | 8/1994 | Japan | 427/420 |
| 6-285420 | 10/1994 | Japan | 427/420 |
| 07172575 | 7/1995 | Japan . | |

*Primary Examiner*—Katherine A. Bareford

*Attorney, Agent, or Firm*—Wood, Herron & Evans, L.L.P.

[57] ABSTRACT

Methods and apparatus for spraying a liquid or hot melt material involve placing the material in a plurality of parallel grooves arranged across the entire width of a movable member and then causing a compressed gas to impinge upon the material in the grooves, thereby to spray the material from the grooves toward a substrate, as by extending, fiberizing or atomizing the material, or by mixing a gas with the material. For some materials of relatively high viscosity, a scraper is used to scrape the material from the grooves, and the compressed gas impinges the material while it is on the scraper, thereby to cause spraying. This provides a wide band deposition of a liquid or hot melt material with uniform material distribution across the entire width, along with improved ability to quantify the amount of material deposited on the substrate.

14 Claims, 2 Drawing Sheets

METHODS AND APPARATUS USING MOVABLE MEMBER FOR SPRAYING A LIQUID OR HOT MELT MATERIAL

FIELD OF THE INVENTION

The invention relates to methods and apparatus for spraying a liquid or hot melt material in a wide band, and more specifically, to methods and apparatus which carry out spraying in a wide band by causing a gas to impinge upon the material to atomize or fiberize it just prior to deposition on a web.

BACKGROUND OF THE INVENTION

Spray coating of a liquid or hot melt in a wide band on a wide and continuously moving substrate or web is required in many industrial fields. For the production of paper diapers, for example, an adhesive is spray coated in a wide band on a long water-impermeable sheet which is wide and fed continously. This lined sheet is adhered to a water-absorbing pad made of a long nonwoven fabric which is also fed continuously. This product is then cut, assembled as one paper diaper, and shipped to the market.

The following examples are the principal methods and apparatus employed in the past for the spraying of an adhesive or coating agent, i.e., a liquid or hot melt material, in a wide band. In the first example, a liquid or hot melt material is sprayed in flat fan form from a nozzle in an airless manner, using a special nozzle as shown in Japanese Kokoku No. 61[1986]-50,655. In the second example, a special nozzle as shown in Japanese Kokai No. 62[1987]-204,873, is used to spray the material in a flat fan form while causing auxiliary air to impinge upon the material as it is ejected from the nozzle. If the third example, while spraying the material from a long and narrow slot nozzle, the sprayed material is contacted by air ejected from a similarly long and narrow slot nozzle, as shown in Japanese Kokai No. 6[1994] -170,308.

In the first and second of these examples, the distribution density of the sprayed material varies between the center section and the two edge sections of the fan-shaped wide spray pattern. The density of sprayed material is higher at the center than at the two edges. Furthermore, when the sprayed material hits the web, the jet stream closer to the two edges of the fan shape strikes at an inclined angle, and thus rebounds easily, compared to the material at the center. As a result, there is variation in amount that sticks at the center compared to the two edges of the fan shape.

In the third example, the material path in the slot nozzle body must widen after leaving the entrance port, in order to eject the liquid or hot melt material in a wide band from the slot nozzle. Various existing devices have been engineered so as to allow the material to flow uniformly over the entire region of the slot nozzle width. Such devices include a so-called coat hanger die widened to a triangle, or finely dividing the slot width into sections and providing each section with a metering gear pump to measure the quantity. While these devices can be used to achieve a uniform material stream of high accuracy across the entire die width, it is sometimes difficult to precisely quanitfy the amount of material which is delivered across the volume of the nozzle.

It is an object of the present invention to provide methods and apparatus for spraying a liquid or hot melt material in a wide band with uniform distribution and high accuracy over the entire region in the width direction.

It is another object of the present invention to facilitate the ability to precisely quantify the amount of liquid or hot melt material sprayed via such a system.

SUMMARY OF THE INVENTION

To attain the above-mentioned objects, the present invention involves placing a liquid or hot melt material in the grooves of a movable member, such as a drum or a rotating mobile body, and thereafter causing a compressed gas to impinge upon the material placed in the grooves to spray the material therefrom in an extended condition, as a fiberized stream, as an atomized stream, as an extended stream, or as a stream mixed with the gas.

The member moves continuously during this spray process, and placement of material in the grooves occurs at a "filling" station located remotely from an "ejection" station, where spraying occurs. Preferably, after the placing step and before the causing step, the material is transferred from the grooves to a scraper, such as a tubular body having one tube for each groove, and the impinging gas stream contacts the material while on the scraper.

The placing step may involve the use of a slot nozzle of a die head, preferably a slot contact coater. Alternatively, the placing step may involve use of a liquid supply tank. The advantage of a liquid supply tank is that it is relatively simple and inexpensive to manufacture, and it is relatively easy to clean, an important feature when frequent material changeover is required. However, it is unsuitable for liquids with relatively high viscosities and for rapidly rotating systems, in which case it is advisable to use a slot nozzle of a die head.

In another aspect of the invention, the compressed gas in the aforesaid methods may be heated, and/or it may also contain a solvent.

With the die head acting in a contact coater capacity, it effectively produces a doctor blade effect, so that the liquid or hot melt material is placed uniformly and completely in a plurality of parallel grooves which encompass the entire width of the movable member. The movable member then moves the material from the filling station to the ejection station, and the compressed gas is blown toward the liquid or hot melt material in the grooves so as to impinge thereon. This causes the material to be separated from the grooves and sprayed vigorously together with the impinging stream of compressed gas, in a manner such that the volume distribution of sprayed material is uniform across the width of the movable member and the web which is coated. This holds true whether the liquid or hot melt material is extended, fiberized, or atomized by the effect of the gas stream, or if the gas is mixed in the liquid or hot melt stream. Moreover, because the volume of the grooves is known, along with the movement speed of the member, this invention allows precision in quantifying the amount of material deposited on the web.

When handling a liquid or hot melt material which does not separate easily from the grooves because of properties such as viscosity, the liquid or hot melt material placed in the grooves is first transferred to a scraper, as described above. This enables the material to be separated easily from the grooves and sprayed. The compressed gas may be blown on the liquid or hot melt material while it is on the scraper, or while it is separating or falling from the scraper.

If the temperature of the compressed gas is low when the material being handled is a hot melt, the temperature of the hot melt will be suddenly lowered, thus there is the danger that full fiberization or atomization might be hindered. For this reason, in many cases it is desirable for the compressed gas to be heated in advance to an appropriate temperature, to prevent the occurrence of a problem due to a change in temperature.

Furthermore, when using a material where volatile components are suddenly vaporized and the viscosity is changed due to the impinging compressed gas, there is a danger that full fiberization or atomization might be hindered. In these instances, the compressed gas may be mixed with a moderate amount of solvent and then ejected, thereby to prevent changes in viscosity and the problems arising therefrom.

By using a scraper having a tubular body with a plurality of independent tubes, wherein each tube has a hole which corresponds to one groove of the movable member, a uniform spray pattern can be obtained across the entire width. This is because the scraper structure prevents any obstruction of equal dispersion of material in the width direction, which could otherwise be caused by mutual pulling and adhesion of the material from adjacently located grooves.

By arranging grooves of the same size equally over the entire width of the movable member, the amount of the material placed in the grooves is kept equal over the entire width, so that no variation occurs in the amount sprayed across the entire width when compared with some conventional techniques. Furthermore, all the spray streams strike nearly perpendicularly when contacting the web to be coated, i.e., the substrate. Thus the rebounded amount decreases and the coating adhesion rate improves, as compared with conventional spraying in flat fan form from one nozzle.

The invention can be applied to the manufacture of particles, fibers, or nonwoven fabrics, apart from the coating of other web or substrate compositions. In particular, to achieve better dispersion of particles or fibers, the method can be adapted to spray a large volume of compressed gas, such as generated by a blower or turbine.

These and other features of the invention will be more readily understood in view of the following detailed description and the drawings.

DETAILED DESCRIPTION OF THE INVENTION

Figure 1:
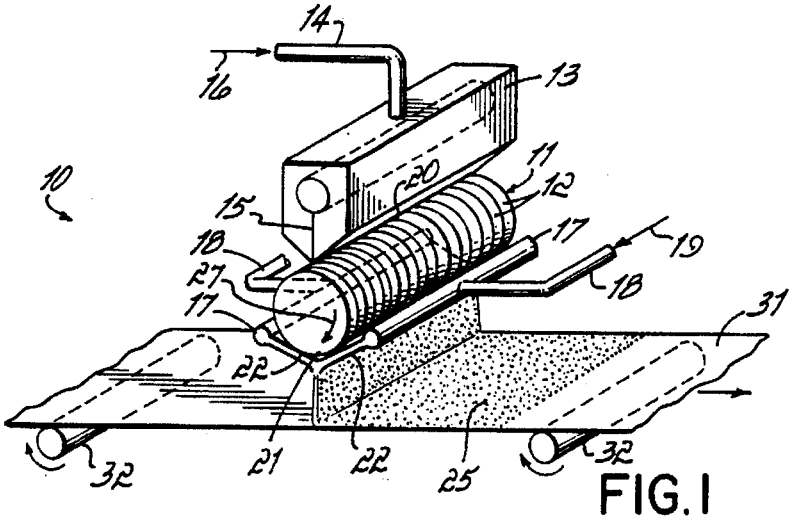
FIG. 1 is a perspective view of a first preferred embodiment of the invention.

FIG. 1 shows an apparatus 10 in accordance with a first preferred embodiment of the invention. The apparatus 10 includes a movable member or body 11, specifically a rotatable drum 11, which has a plurality of grooves 12 provided at equal intervals across the entire width on the surface thereof. The drum 11 is rotated by a rotating mechanism (not shown). The shape of the grooves 12 is not particularly critical, e.g., the grooves 12 can be V-shaped, U-shaped, or semicircular, but for uniform and continuous application it is important that the grooves 12 be the same size across the entire width of the drum 11. An applicator 13, in this instance a die head 13, is located above the drum 11, and the die head 13 connects to a tubular supply line 14 to receive a liquid or hot melt material 16, which is pressure fed from a liquid or hot melt feeder (not shown). The die head 13 places the material 16 in the grooves 12 across the entire width of the drum 11, via a slot nozzle 15 located at the bottom end of the die head 13. Preferably, the die head 13 operates as a contact coater to provide a doctor blade effect, so that the material 16 uniformly fills all the grooves 12.

An air spray head 17 is located at the bottom of the drum 11, opposite the die head 13, on both sides thereof. The air spray head 17 receives hot air, represented by directional arrow 19, which is fed from a compressed air supply (not shown) connected to a tubular supply line 18. The air is ejected vigorously toward roughly the lowest part 21 of the grooves 12 from a pair of slot-shaped air nozzles 22, which form part of the air spray head 17. The air nozzles 22 extend the entire width of the drum 11. A long web or substrate 31 is located below the apparatus 10, and is moved continuously with respect to the apparatus 10 on rollers 32.

In a method of operating the apparatus 10, the liquid or hot melt material 16 is pressure fed to the die head 13 via the supply line 14, and directed from the slot nozzle 15 of the die head 13 into the grooves 12 of the rotating drum 11 at a "filling" station 21, preferably via contact extrusion. The material 16 placed in the grooves 12 quickly advances by the rotation of the drum 11 to a position where the pair of slot-shaped air nozzles 22 are located, at an "ejection" station at the bottom of the drum 11.

Figure 2:
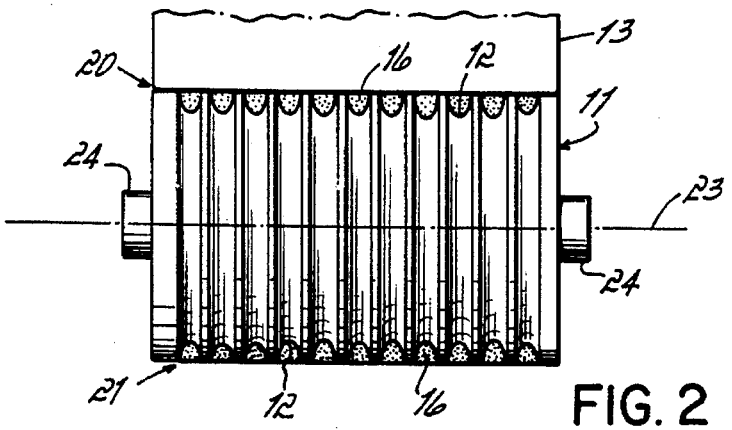
FIG. 2 is a side view of the rotating drum shown in FIG. 1.

FIG. 2 shows the top 20 and the bottom 21 of the drum 11, which represent the filling and the ejection stations, respectively. FIG. 2 also shows an axis 23 of rotation for the drum 11 and mounting hubs 24. When the material 16 reaches the ejection station 21, compressed air supplied to the air spray head 17 via the air supply line 18 is violently ejected toward the grooves 12 from the pair of slot-shaped air nozzles 22, so that the material 16 is stripped from the grooves 12 and sprayed as a fiberized or atomized spray together with the ejected air, thereby causing it to deposit in a pattern 25 on the web 31 moving on the rollers 32. The width of the pattern 25 corresponds to the width of the member 11, or more specifically, the width of the plurality of grooves 12. This width can be selected as desired to produce any particular pattern width.

Because the size of the grooves 12 is identical across the movable member 11, and the material 16 is placed and distributed in the plurality of grooves 12 across the entire width of the drum 11, this method effectively performs a measuring function in the width direction to achieve spraying of a uniform amount of material 16, with no variation across the entire width of the apparatus 10. This results in uniformity across the width of the pattern 25. It also facilitates precise measurement of the quantity of material 16 delivered to the web 31.

When it is desired to increase or decrease the amount to be sprayed in a portion of the width direction of the drum 11, this can be accomplished by using a drum 11 where the size of the grooves 12 for that portion is changed. Moreover, if desired, the grooves 12 can be discontinuous in some sections to produce intermittent discontinuities in the pattern 25, such as at the outer edges of the web 31, a pattern 25 which is commonly used for diaper backsheets. Regardless of the size and shape of the grooves 12, the volume of the grooves 12 remains known, so even with these variations of the invention, it is still relatively easy to quantify the amount of material 16 deposited on the web 31.

Figure 3:
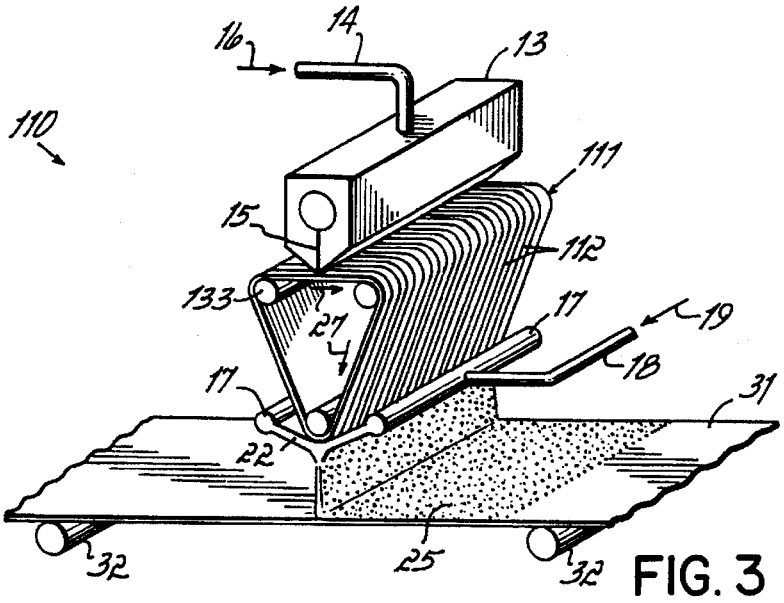
FIG. 3 is a perspective view, similar to FIG. 1, of a second preferred embodiment of the invention, using an endless belt as the movable member.

FIG. 3 shows a second preferred embodiment 110 of the invention, wherein an endless belt 111 is used as the movable member or body. The other structures are similar to those of FIG. 1, and thus have the same reference numerals as in FIG. 1, so their detailed description will be omitted here.

For the endless belt version of the movable body 111, a plurality of grooves 112 are provided at equal intervals over the entire width, on the surface of the movable body 111. The movable body 111 moves circuitously about a drive mechanism, in this case three rotating rollers 133, in the direction shown by directional arrows 27. As in FIG. 1, with this embodiment the die head 13 receives a liquid or hot melt material 16 via a supply line 14 which is pressure fed from a feeder (not shown). This causes placement of the material 16 from the slot nozzle 15 into the grooves 112 provided across the entire width of the movable body 111, at the filling station 120. Again, this preferably occurs via contact extrusion, to assure uniform filling of the grooves 112.

Similarly, the air spray head 17, which includes two halves located on both sides of the lowest part of the rotating body 111, receives air which is supplied from a compressed air feeder (not shown) connected to line 18. The air spray head 17 ejects the air vigorously toward the ejection station 121, located at the lowest part of the grooves 112, with the air ejected from a pair of slot-shaped air nozzles 22 which extend the entire width of the movable body 111. This causes the material 16 to be stripped from the grooves 112 and sprayed as a fiberized or atomized spray together with the ejected air, and applied to the surface of the web 31 moving on the rollers 32.

This apparatus 110 provides the same advantages as apparatus 10 with respect to spray uniformity across the width of the pattern 25, along an improved ability to precisely quantify the amount of material 16 deposited. Also, the amount to be sprayed in a portion in the width direction of the rotating body 111 may be increased or decreased by changing the size or shapes of the grooves 112 for that portion, or even by eliminating sections of the grooves 112, as described previously.

Figure 4:
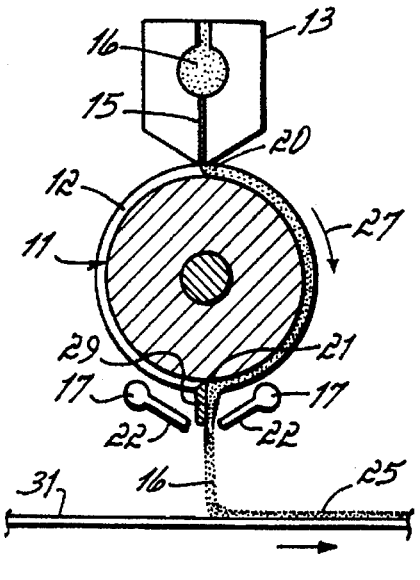
FIG. 4 is a side view which shows another aspect of this invention, wherein the apparatus includes a scraper.

FIG. 4 shows a scraper 29 which is used when the liquid or hot melt material is highly viscous, as in a hot melt adhesive. The structures other than the scraper 29 are basically the same as in the example of FIG. 1, and thus given the same reference numerals as in FIG. 1, so their detailed description will be omitted here. The scraper 29 is located at the ejecting station 21, adjacent the bottom of the drum 11. During the rotation of the drum 11, material 16 from the grooves 12 is transferred successively to the surface of the scraper 29 by the scraping action of the scraper 29 against the surface of the drum 11. Even if the material 16 is a material with a high viscosity such as a hot melt adhesive, it can be separated completely from the grooves 12 by the scraper 29. The material 16 is then fiberized or atomized by air that is ejected from the slot-shaped air nozzles 22, causing spray of the material 16 toward the web 31.

Depending on the nature and characteristics of the material 16, when in the adjacent grooves 12 it may pull and adhere locally when scraped with a scraper 29 of flat plate shape, thereby obstructing equal dispersion of material 16 across the entire width of the web 31.

Figure 5:
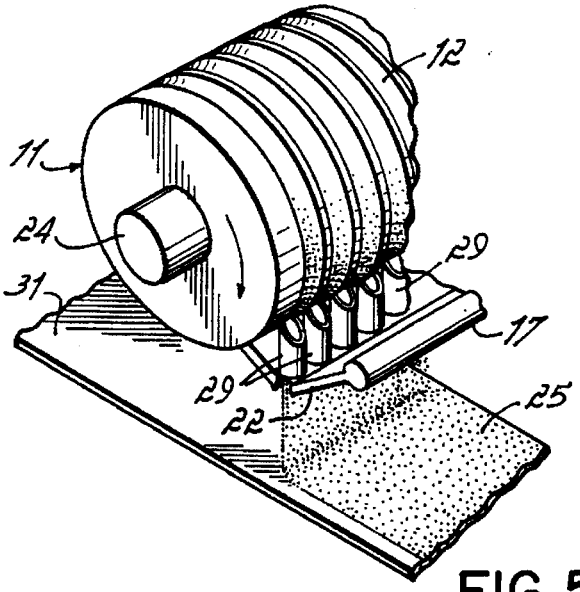
FIG. 5 is a perspective view which shows another variation of the invention, using another form of scraper.

To accommodate this potential problem, the invention contemplates a scraper 129 of the type shown in FIG. 5. With this scraper 129, unequal dispersion in the width direction can be prevented because of the parallel tube construction, with one independent tube corresponding to one groove 12 of the rotating member 11. A sharpened edge may be provided closest to the drum 11, to effectively direct the material 16 from the grooves 12 to the scraper 129.

Figure 6:
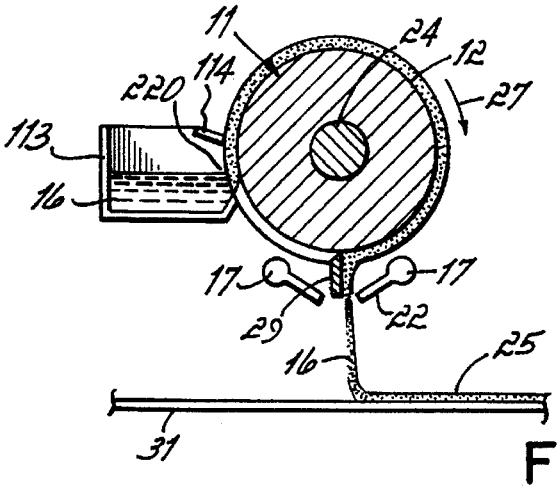
FIG. 6 is a side view which illustrates still another variation of the invention, whereby a liquid supply tank is used to fill the grooves.

FIG. 6 shows another structure, wherein a liquid supply tank 113 serves as the applicator for placing the material 16 in the grooves 12. The other components are basically the same as in the example shown in FIG. 1, and are thus given the same reference numerals, so their detailed description will be omitted here.

The material 16 is placed in the liquid supply tank 113 to a level such that the material 16 comes into full contact with the grooves 12 of the drum 11. Thus, the filling station 220 is located at a side of the drum 11, rather than the top. A doctor knife 114 is provided on the lower stream side of rotation, and it prevents excess adhesion of the material 16 to the drum 11. This method is simple and it is relatively inexpensive. It also has an advantage in that it can be cleaned easily in cases where the material 16 is frequently changed. However, it also has disadvantages such that rotation of the drum 11 causes waving of the liquid surface in relatively fast rotating systems, and materials 16 of relatively high viscosity adhere to the drum 11 in excessive quantities. Thus, the selection of this method and structure depends on the nature of the material 16 and the spraying conditions.

If the temperature of the compressed gas is low when the material 16 handled is a hot melt, air impingement will cause the temperature of the hot melt to be suddenly lowered, and there is the danger that full fiberization or atomization might be hindered. Therefore, the compressed gas should be heated in advance to an appropriate temperature, to avoid any potential problems which could be caused by a change in temperature of the material 16.

Furthermore, there are in instances where the material 16 contains volatile components which may vaporize and change in viscosity upon collision with the compressed gas, and there is a danger that full fiberization or atomization of the material 16 might be hindered. For such a material 16, a moderate amount of solvent can be added to the compressed gas, thereby preventing the occurrence of problems due to changes in viscosity.

While several preferred embodiments of the invention have been described, it is to be understood that the invention is not limited thereby and that in light of the present disclosure, various other alternative embodiments will be apparent to a person skilled in the art. Accordingly, it is to be understood that changes may be made without departing from the scope of the invention as particularly set forth and claimed.

I claim:

1. A method for depositing a liquid or hot melt material on a substrate comprising the steps of:

placing the material in a plurality of parallel grooves arranged across a width of a moving member, at a filling station; and causing a gas to impinge upon the material in the grooves of the moving member at an ejection station located adjacent the moving member, the ejection station being remote from the filling station, whereby the impingement of the gas on the material in the grooves ejects the material therefrom and directs the material toward the substrate for deposition thereon in a uniform manner across a width corresponding to the width of the member, thereby depositing the material on the substrate.

2. The method of claim 1 wherein the causing step results in directing of the material toward the substrate, in a condition selected from the following conditions: extended, fiberized and atomized.

3. The method of claim 1 and further comprising the step of:

heating the gas prior to the causing step.

4. The method of claim 1 and further comprising the step of:

mixing a solvent with the gas prior to the causing step, so that the causing step results in impingement on the material by a solvent/gas mixture.

5. An apparatus for depositing a liquid or hot melt material on a substrate comprising:

a movable member having a plurality of grooves at an outer surface thereof, the grooves arranged parallel across a first desired width;

an applicator adapted to receive the material and to transfer the material, at a filling station, to the grooves during movement of the movable member, the material transfer occurring across the first desired width; and a pair of elongated air nozzles extending along the first desired width and directed at the movable member at an ejection station, for directing a compressed gas toward the material in the grooves as the member moves through the ejection station, thereby causing impingement of the gas with the material in the grooves and causing it to be ejected therefrom toward the substrate for deposition thereon, in a pattern which has a width corresponding to the first desired width.

6. The apparatus of claim 5 wherein the movable member comprises:

a rotatable drum having grooves encircling the circumference thereof, the drum movable by rotation between the filling station and the ejection station.

7. The apparatus of claim 6 wherein the size, shape and distribution of the grooves correspond to a desired pattern of coverage on the substrate.

8. The apparatus of claim 6 and further comprising:

a scraper mounted adjacent the movable member at the ejection station and residing in surface engagement with the grooves, thereby to facilitate removal of the material therefrom during movement of the member and impingement of the gas.

9. The apparatus of claim 8 wherein the scraper further comprises:

a plurality of tubes arranged in side by side relationship across the first desired width, with each tube corresponding to one groove.

10. The apparatus of claim 6 wherein the applicator further comprises:

a slot nozzle die head adapted to extrude the material into the grooves at the filling station along the first desired width.

11. The apparatus of claim 10 wherein the slot nozzle is located above the movable member so that the filling station is located at an upper end of the movable member.

12. The apparatus of claim 6 wherein the applicator further comprises:

a tank adapted to hold a liquid material in contact with the movable member to affect transfer of the material to the grooves at the filling station along the first desired width, the filling station located at a side of the movable member.

13. The apparatus of claim 5 wherein the movable member further comprises:

an endless belt having outwardly directed grooves encircling an outer surface thereof and a plurality of rotatable rollers contacting the endless belt on an internal surface thereof and adapted to move the belt around an endless loop.

14. The apparatus of claim 5 wherein the shape and structure of the grooves are configured to achieve a desired pattern of deposition on the substrate.

* * * * *